US008979404B2

(12) United States Patent
Mori

(10) Patent No.: US 8,979,404 B2
(45) Date of Patent: Mar. 17, 2015

(54) IMAGE FORMING APPARATUS, IMAGE FORMING SYSTEM AND PROGRAM PRODUCT

(75) Inventor: Hiromi Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1124 days.

(21) Appl. No.: 11/389,034

(22) Filed: Mar. 27, 2006

(65) Prior Publication Data

US 2006/0228138 A1 Oct. 12, 2006

(30) Foreign Application Priority Data

Mar. 25, 2005 (JP) ..... 2005-088261

(51) Int. Cl.
*B41J 11/44* (2006.01)
*B41J 11/48* (2006.01)
*G03G 15/00* (2006.01)

(52) U.S. Cl.
CPC ..... *B41J 11/485* (2013.01); *G03G 15/6508* (2013.01)
USPC ..... 400/76

(58) Field of Classification Search
CPC ..... G03G 15/5012; G03G 15/5016; G03G 15/6508; G03G 2215/00447; B65H 2511/416
USPC ..... 400/76; 399/389, 391, 366
See application file for complete search history.

(56) References Cited

U.S. PATENT DOCUMENTS 5,459,580 A 10/1995 Suzuki
6,381,422 B1 * 4/2002 Tanaka ..... 399/45
6,701,099 B2 * 3/2004 Yokobori et al. ..... 399/45
2001/0009615 A1 7/2001 Yokobori et al.
2003/0215252 A1 11/2003 Yokobori et al.
2004/0109717 A1 6/2004 Higuchi
2004/0156056 A1 * 8/2004 Sawada ..... 358/1.2

FOREIGN PATENT DOCUMENTS

JP 58 117565 7/1983
JP 59 53325 3/1984
JP 62 161647 7/1987

(Continued)

OTHER PUBLICATIONS

European Patent Office, European Search Report for EP Appl'n 06005304.8-2304 (counterpart to above-captioned US Patent Appl'n) mailed Aug. 7, 2006.

(Continued)

*Primary Examiner* — Matthew G Marini
(74) *Attorney, Agent, or Firm* — Baker Botts L.L.P.

(57) ABSTRACT

An image forming apparatus including: an image forming unit; plural trays; a sheet feed unit that feeds a sheet held in one of the trays; a correspondence storing unit that stores correspondence between trays and kinds of sheets; a priority setting unit that sets priority to a designation of the tray or to a designation of the kind; a sheet feed control unit that feeds the sheet from one of the trays when the priority is given to the designation of the tray and the one of the trays is designated, and searches one of the trays that holds the sheet of the designated kind based on the correspondence to feed the sheet from the searched tray when the priority is given to the designation of the kind and the kind of the sheet is designated; and a setting change unit that changes a setting of the image forming unit correspondingly to the kind of sheet.

20 Claims, 11 Drawing Sheets

(56) References Cited

FOREIGN PATENT DOCUMENTS

| | | |
|---|---|---|
| JP | 2 182631 | 7/1990 |
| JP | 2 182632 | 7/1990 |
| JP | 2182631 | 7/1990 |
| JP | 2182632 | 7/1990 |
| JP | H02-182632 A | 7/1990 |
| JP | 3 192038 | 8/1991 |
| JP | 4 288568 | 10/1992 |
| JP | H06-102732 A | 4/1994 |
| JP | 10 53338 | 2/1998 |
| JP | 1053338 | 2/1998 |
| JP | 10 87092 | 4/1998 |
| JP | 1087092 | 4/1998 |
| JP | H11-048580 A | 2/1999 |
| JP | 2000 128374 | 5/2000 |
| JP | 2000 143017 | 5/2000 |
| JP | 2000143017 | 5/2000 |
| JP | 2000 225752 | 8/2000 |
| JP | 2000225752 | 8/2000 |
| JP | 2001-166641 A | 6/2001 |
| JP | 2001 328740 | 11/2001 |
| JP | 2001328740 | 11/2001 |
| JP | 2002 149387 | 5/2002 |
| JP | 2002149387 | 5/2002 |

OTHER PUBLICATIONS

State Intellectual Property Office Notification of First Office Action for Chinese Patent Application No. 200610065492.8 (counterpart to the above-captioned patent application), dated Mar. 14, 2008.

Japan Patent Office, Office Action in counterpart Patent Application No. JP 2005-088261, mailed Nov. 24, 2009.

* cited by examiner

FIG. 6

91

| | |
|---|---|
| Multi-purpose tray<br>Main feed tray<br>Optional feed tray | Heavy sheet<br>Plain sheet<br>Not defined |

FIG. 7

91

| | |
|---|---|
| Priority order | Sheet kind<br>Tray<br>None |

(FIG. 10 CONTINUED)
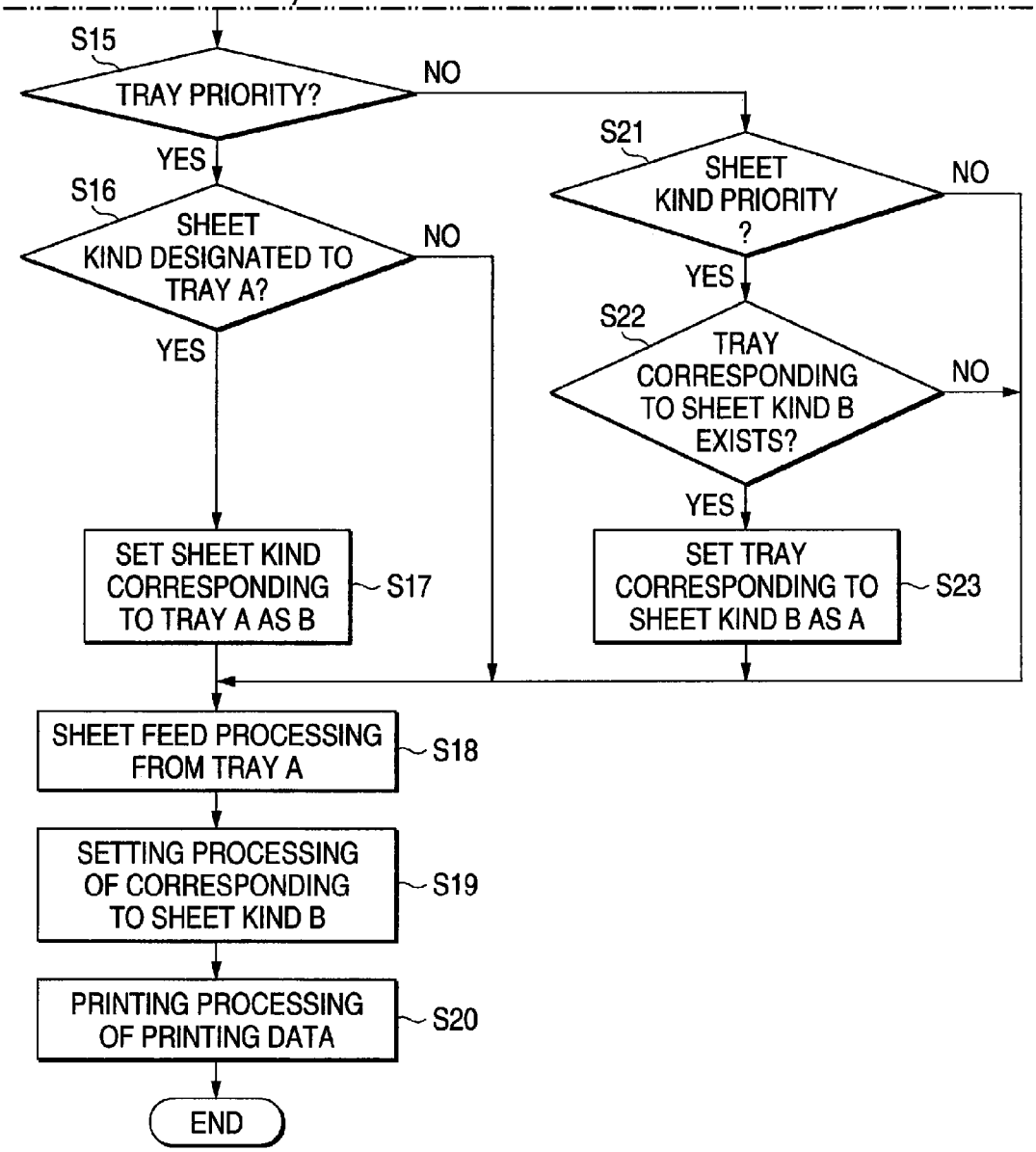

IMAGE FORMING APPARATUS, IMAGE FORMING SYSTEM AND PROGRAM PRODUCT

CROSS REFERENCE TO RELATED APPLICATION

This application claims priority from Japanese Patent Application No. 2005-088261, filed on Mar. 25, 2005, the entire subject matter of which is incorporated herein by reference.

TECHNICAL FIELD

Aspects of the present invention relate to an image forming apparatus including a plurality of trays, for forming an image on a sheet held in any one of the trays, an image forming system including the image forming apparatus and an upper apparatus and a program product for controlling the image forming apparatus or the image forming system.

BACKGROUND

An image forming apparatus including an image forming unit for forming an image on a sheet, a plurality of trays each holding sheets on which the image is formed by the image forming unit, and a feed unit for feeding sheets held in any one of the trays to the image forming unit has been conventionally proposed. In such image forming apparatus, it is possible to form an image on a sheet by feeding sheets held in any one of the trays each holding sheets to the image forming unit by the feed unit. Further, in such image forming apparatus, there has been proposed that a unit for detecting the size and kind of sheet held in a tray is provided and, when the size and kind of sheet is designated by an upper apparatus, an image is formed by automatically selecting the tray holding sheets of the designated size and the kind and feeding the sheet (for example, see JP-A-2-182632).

SUMMARY

When both of the size and kind of sheet are designated and there is no sheet of the designated size and kind, the apparatus disclosed in JP-A-2-182632 enters into a sleep mode. Therefore, in order to form an image, there may be a case where the designation of size and kind of sheet has to be made repeatedly, resulting in degraded operability. The present invention provides an image forming apparatus or an image forming system capable of smoothly forming an image even when both the tray and the kind of sheet are designated and there is no sheet satisfying the designation of the tray and the kind.

According to an aspect of the invention, there is provided an image forming apparatus including: an image forming unit that forms an image on a sheet; a plurality of trays each for holding the sheet on which the image is formed by the image forming unit; a sheet feed unit that feeds the sheet held in one of the plurality of the trays; a correspondence storing unit that stores correspondence between trays and kinds of sheets held in the trays; a priority setting unit that sets priority to a designation of the tray or to a designation of the kind; a sheet feed control unit that causes the sheet feed unit to feed the sheet from one of the trays when the priority is given to the designation of the tray by the priority setting unit and the one of the trays is designated, and searches one of the trays that holds the sheet of the designated kind on the basis of the correspondence between trays and kinds of sheets stored in the correspondence storing unit to cause the sheet feed unit to feed the sheet from the searched tray when the priority is given to the designation of the kind by the priority setting unit and the kind of the sheet is designated; and a setting change unit that changes a setting of the image forming unit correspondingly to the kind of sheet fed by the sheet feed control unit.

In the aspect constructed as described above, the correspondence storing unit stores the trays and the kinds of sheets held in the respective trays by bringing them into connection. It is possible to set the tray priority or the sheet kind priority by the priority setting unit. The sheet feed control unit causes the sheet feed unit to feed sheets from one of the trays when the priority of the tray is set by the priority setting unit and the one tray is assigned. In this case, since the setting change unit changes the setting of the image forming unit according to the kind of sheet fed by the sheet feed control unit, it is possible to feed the sheets from the assigned tray and to form a good image on the sheet by the image forming unit.

Further, when the sheet kind priority is set by the priority setting unit and the sheet kind is assigned, the sheet feed control unit searches one of the trays, which holds sheets of the assigned kind of sheet, on the basis of the correspondence between trays and sheet kinds stored in the correspondence storing unit and, when the one tray is searched, feeds the sheets from the searched tray. In this case, since the setting change unit changes the setting of the image forming unit according to the kind of sheet fed by the sheet feed control unit, it is also possible to form a good image on the assigned sheet.

As mentioned, it is possible in the present invention to select sheets based on the assignment set by the priority setting unit and to form an image on the sheets by the setting according to the sheet kind. Therefore, according to the present invention, it is possible to prevent the image forming apparatus from being fallen in the sleep state unnecessarily. Further, since the setting of the image forming unit is changed according to the sheet kind, it is also possible to form a good image according to the kind of the sheet.

BRIEF DESCRIPTION OF THE DRAWINGS

Illustrative aspects of the invention may be more readily described with reference to the accompanying drawings:

FIG. 6 shows a correspondence setting screen in the laser printer;

FIG. 7 shows a priority order setting screen in the laser printer;

DETAILED DESCRIPTION

Figure 1:
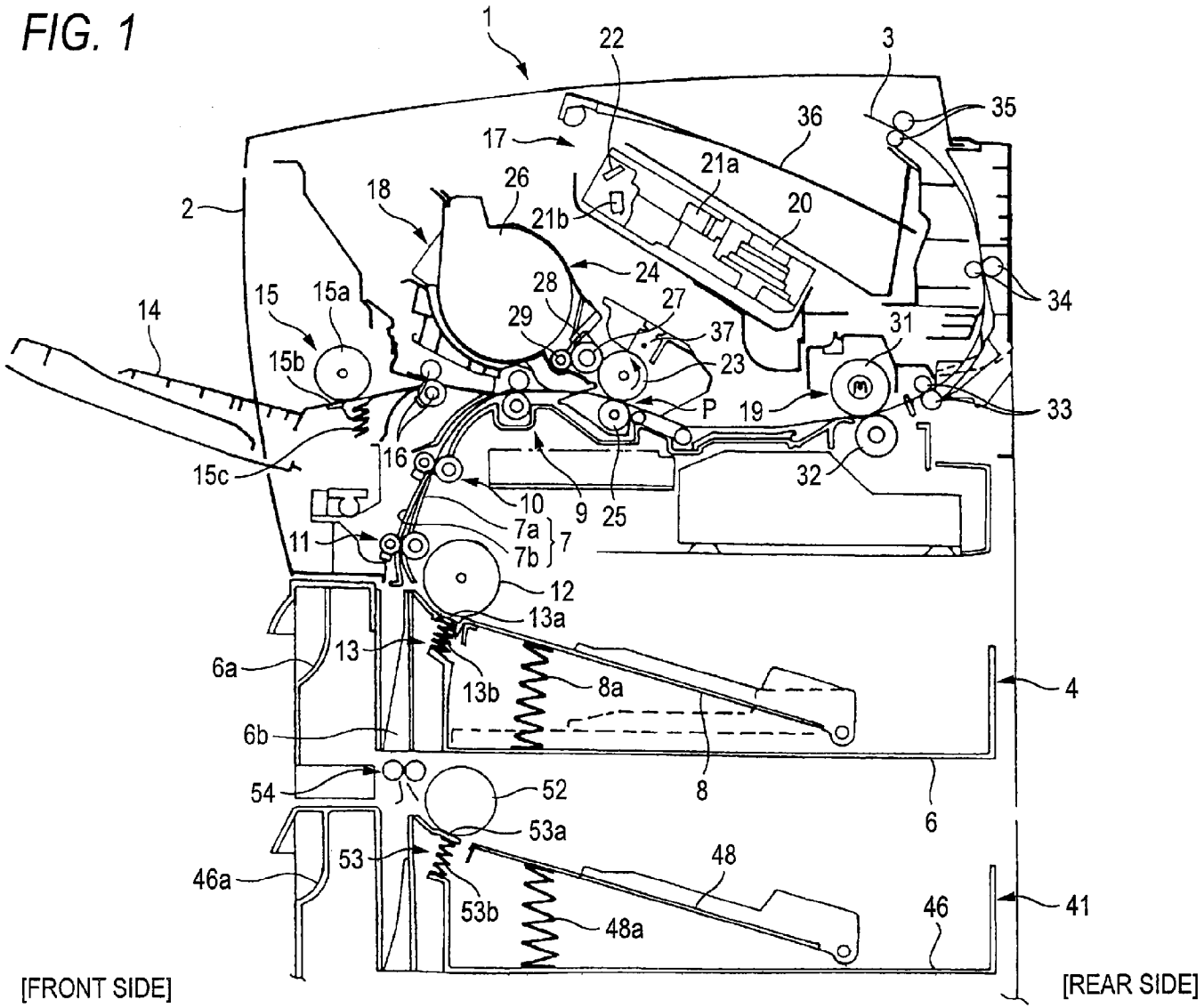
FIG. 1 is a schematic cross sectional view showing a construction of a laser printer according to an aspect of the present invention.
Figure 2:
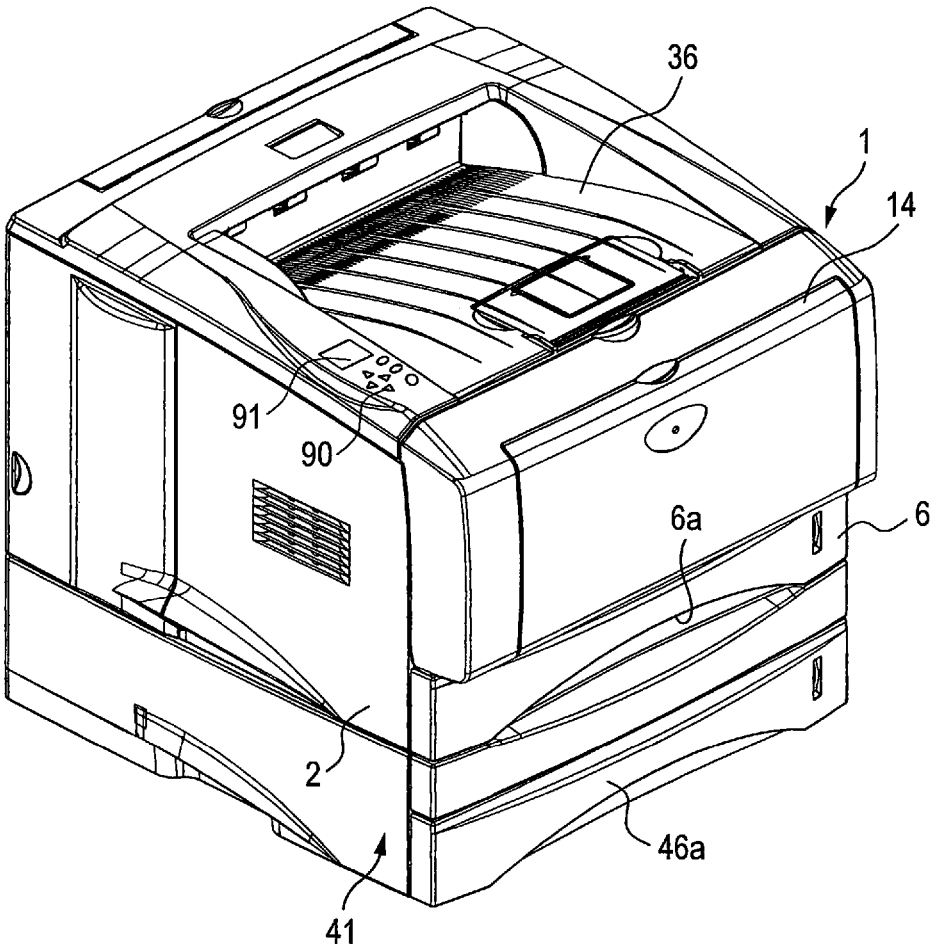
FIG. 2 is a perspective view showing an outer configuration of the laser printer.

The present invention will be described with reference to aspects of the present invention. Incidentally, the present invention is not limited to the aspects to be described and may be modified in various manners within the technical scope of the present invention. FIG. 1 is a schematic cross sectional view of a laser printer 1 as an image forming apparatus to which the present invention is applied and FIG. 2 is a perspective view showing an outer configuration of the laser printer 1.

[Construction of Laser Printer 1]

As shown in FIG. 1, the laser printer 1 of this aspect includes a main casing 2, in which a feeder 4 for feeding sheets 3 on which images are recorded, a multi-purpose tray 14, a process unit 18 for forming an image on a fed sheet 3 and a fixing unit 19, etc. The laser printer 1 has an optional tray 41 provided below the feeder 4. The optional tray 41 can be added optionally. In the following description, a side (left side in FIG. 1) of the main casing 2 of the laser printer 1, on which the multi-purpose tray 14 is mounted, is referred to as a "front side" and the other side of the main casing 2 is referred to as a "rear side".

[Construction of Feeder 4]

As shown in FIG. 1, the feeder 4 includes a sheet feed tray 6 detachably mounted in the bottom of the main casing 2, a sheet urging plate 8 provided within the sheet feed tray 6, a feed roller 12 and a separating pad 13, which are provided above one end portion of the sheet feed tray 6. Further, a curved transporting path 7 extends from the feed roller 12 to an image forming position P (a contact portion between a photosensitive drum 23 and a transfer roller 25, that is, a transferring position on the photosensitive drum 23 at which a toner image on the drum is transferred to the sheet 3).

A rear end portion of the sheet urging plate 8, which can hold a stack of sheets 3, is swingably supported and a front end thereof in the vicinity of the sheet feed roller 12 is vertically movable. The sheet urging plate 8 is urged upward by a spring 8*a*. The separating pad 13 is provided below and against the sheet feed roller 12 and has a pad 13*a* formed by a member having large coefficient of friction. The pad 13*a* is urged against the sheet feed roller 12 by a spring 13*b*.

Figure 4:
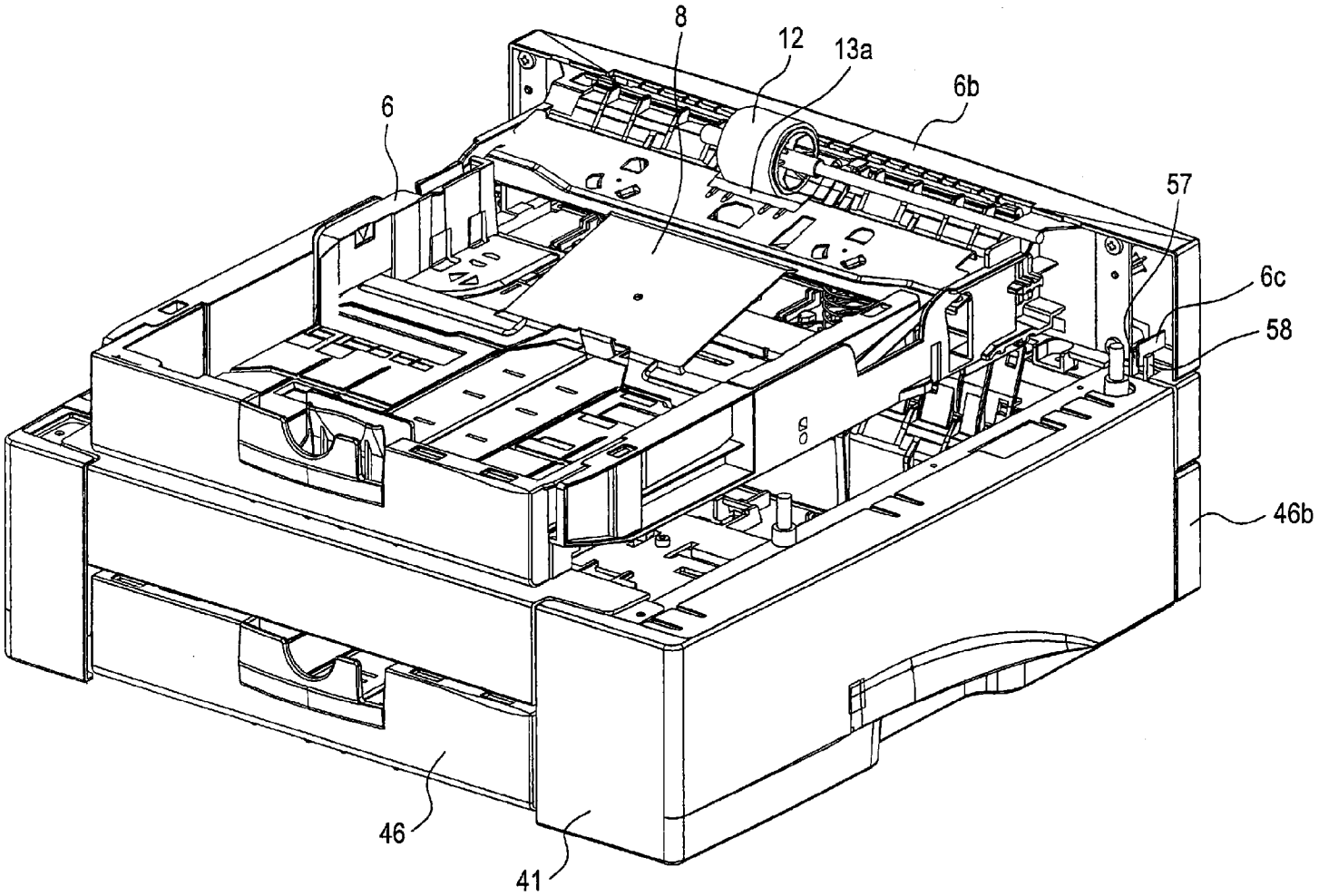
FIG. 4 is a perspective view showing a construction of a light emitting element and a light receiving element, etc., of the optional tray.

Incidentally, the pad 13*a* and the sheet feed roller 12 have widths in a direction perpendicular to the transporting direction of the sheet 3 smaller than the width of the sheet 3 and are arranged such that the pad 13*a* and the sheet feed roller 12 are in contact with only substantially a center portion in the width direction of the sheet 3 during a sheet feed operation (see FIG. 4).

The transporting path 7 is formed by a pair of guide plates 7*a* and 7*b* for guiding the surfaces of the sheet 3. Along the transporting path 7, the sheet feed roller 12, a pair of transporting rollers 11 including a drive roller and a driven roller, a pair of transporting rollers 10 including a drive roller and a driven roller and a pair of registration rollers 9 including a drive roller and a driven roller and provided immediately before the image forming position P are arranged from an upstream side of the transporting path to a downstream side with appropriate intervals.

In the feeder 4 constructed as described above, an uppermost sheet 3 of the sheets 3 stuck on the sheet urging plate 8 is pressed toward the feed roller 12, pinched between the rotating feed roller 12 and the separating pad 13 so that the sheets 3 are fed one by one. The sheet 3 thus fed is transported sequentially by the transporting rollers 11 to the transporting rollers 10 and the registration rollers 9 and sent to the image forming position P after the sheet 3 is subjected to the certain registration.

[Construction of Multi-Purpose Tray 14]

On the front side of main casing 2 above the feeder 4, the multi-purpose tray 14 for feeding the sheet 3 by hand or automatically, and a sheet feed mechanism 15 for feeding a stack of sheets 3 on the multi-purpose tray 14 are provided. The sheet feed mechanism 15 includes a feed roller 15*a* and a feed pad 15*b*. The feed pad 15*b* is urged against the multi-purpose feed roller 15*a* by a spring 15*c* provided on the back of the feed pad 15*b*. The multi-purpose tray 14 includes a pair of transporting rollers 16 including a drive roller and a driven roller.

In the multi-purpose tray 14 constructed as described above, the sheets 3 stuck on the tray 14 are pinched between the rotating feed roller 15*a* and the feed pad 15*b* one by one and sent to the registration rollers 9 through the transporting rollers 16.

[Construction of Scanner Unit 17]

A scanner unit 17 is provided below a discharge tray 36 provided in an upper portion of the main casing 2. The scanner unit 17 includes a laser light emitter (not shown), a polygon mirror 20, which is rotated, lenses 21*a* and 21*b* and a reflection mirror 22. Laser beam containing an image data and emitted by the laser emitter is reflected and transmitted through the polygon mirror 20, the lens 21*a*, the reflection mirror 22 and the lens 21*b* and scans the surface of the photosensitive drum 23 in the process unit 18 at high speed.

[Construction of Process Unit 18]

The process unit 18 is constructed with a drum cartridge, which includes the photosensitive drum 23 as an electrostatic latent image carrier, a scorotron type electrostatic charger 37 and a transfer roller 25 as a transfer unit and a developer cartridge 24. The developer cartridge 24 includes a toner holder 26, a developing roller 27 as a developing unit, a layer thickness control blade 28 and a toner supply roller 29, etc.

The toner holder 26 is filled with non-magnetic, positively chargeable mono-component polymer toner as the developer. The toner is supplied to the developing roller 27 by the toner supply roller 29 while being charged positively by friction between the rollers 27 and 29. Toner supplied on the developing roller 27 forms a thin layer, thickness of which is regulated to a constant value by the thickness control blade 28. The photosensitive drum 23 is arranged oppositely to the developing roller 27 and electrically grounded. On the photosensitive drum 23, a positively chargeable photosensitive layer of an organic photosensitive material such as polycarbonate is formed.

In this laser printer 1, residual toner on the surface of the photosensitive drum 23 after a toner image is transferred to the sheet 3 by the transfer roller 25 is recovered by the developing roller 27. Since this recovering system, which is so-called "cleaner-less system", recovers the residual toner on the surface of the photosensitive drum 23, it does not require a cleaner such as a cleaning blade and a reservoir of used toner, and therefore it is possible to make the device simple and reduce the size and cost of the device.

The scorotron type electrostatic charger 37 is arranged above the photosensitive drum 23 with a predetermined gap with respect to the drum 23 such that it is not in contact with the drum. The scorotron type electrostatic charger 37, which generates corona discharge by charging wires of such as tungsten, is constructed such that the surface of the photosensitive drum 23 is positively charged uniformly.

With rotation of the photosensitive drum 23, the surface thereof is positively charged uniformly by the scorotron type charger 37 and exposed by high speed scanning of laser beam from the scanner unit 17, resulting in formation of the electrostatic latent image based on the image data.

Thereafter, with the rotation of the developing roller 27, positively charged toner on the developing roller 27 is supplied onto the electrostatic latent image formed on the photosensitive drum 23, which is in contact with the developing roller 27, that is, onto a portion of the positively charged surface of the photosensitive drum 23, potential of which is lowered by the exposure with the laser beam, resulting in formation of a visible toner image.

The transfer roller 25 is arranged below the photosensitive drum 23 and opposes thereto. The transfer roller is supported by the drum cartridge rotatably in clockwise direction in FIG. 1. The transfer roller 25 is constructed with a metal roller shaft and a roller, which is formed of an ion-conductive rubber and fitted on the roller shaft, such that it is biased by a transfer biasing power source during the transfer operation. Therefore, the toner image on the surface of the photosensitive drum 23 is transferred onto the sheet 3 in the image forming position P during the sheet 3 passes between the photosensitive drum 23 and the transfer roller 25.

[Construction of Fixing Unit 19]

The fixing unit 19 is arranged on a downstream side of the transporting direction with respect to the process unit 18, as shown in FIG. 1, and includes a heating roller 31, a pressing roller 32 provided to urge the heating roller 31 and a pair of transporting rollers 33 provided on a downstream side of the pressing roller 32. The heating roller 31 is formed of metal such as aluminum and includes a heater such as a halogen lamp. The heating roller 31 functions to thermally fix toner transferred onto the sheet 3 in the process unit 18 during the sheet 3 passes between the heating roller 31 and the pressing roller 32. Thereafter, the sheet 3 is transported by the transporting rollers 33, transporting rollers 34 and discharge rollers 35 along a discharge path formed in the rear portion of the main casing 2 and discharged onto the discharge tray 36. Incidentally, the scanner unit 17, the process unit 18 and the fixing unit 19 function as the image forming unit.

[Construction of Optional Tray 41]

An internal construction of the optional tray 41, which is optionally provided below the feeder 4, is substantially the same as that of the feeder 4. That is, the optional tray 41 includes an optional sheet feed tray 46 detachably provided in a bottom portion of the optional tray 41, a sheet urging plate 48 having one end swingably supported by the optional sheet feed tray 46 and urged by a spring 48*a*, a sheet feed roller 52 provided above the other end of the sheet urging plate 48 and a separating pad 53. The separating pad 53 is arranged oppositely to the sheet feed roller 52 and has a pad 53*a* urged to the sheet feed roller 52 by a spring 53*b*.

A passage 6*b*, which is capable of passing a sheet 3 vertically between a swinging range of the sheet urging plate 8 and a handle 6*a* on the front side of the sheet feed tray 6, is provided in the sheet feed tray 6, which is attached to the feeder 4. Further, a pair of transporting rollers 54 including a drive roller and a driven roller are provided below the passage 6*b*. Therefore, when the sheet feed tray 6 of the feeder 4 is put in a normal position (position at which the sheet 3 can be fed to the transporting path 7 by the sheet feed roller 12), the sheets 3, which are supplied one by one by the sheet feed roller 52 of the optional tray 41, are transported by the transporting rollers 54 and, thereafter, sent to the transporting passage 7 through the passage 6*b* by the transporting rollers 11.

Figure 3:
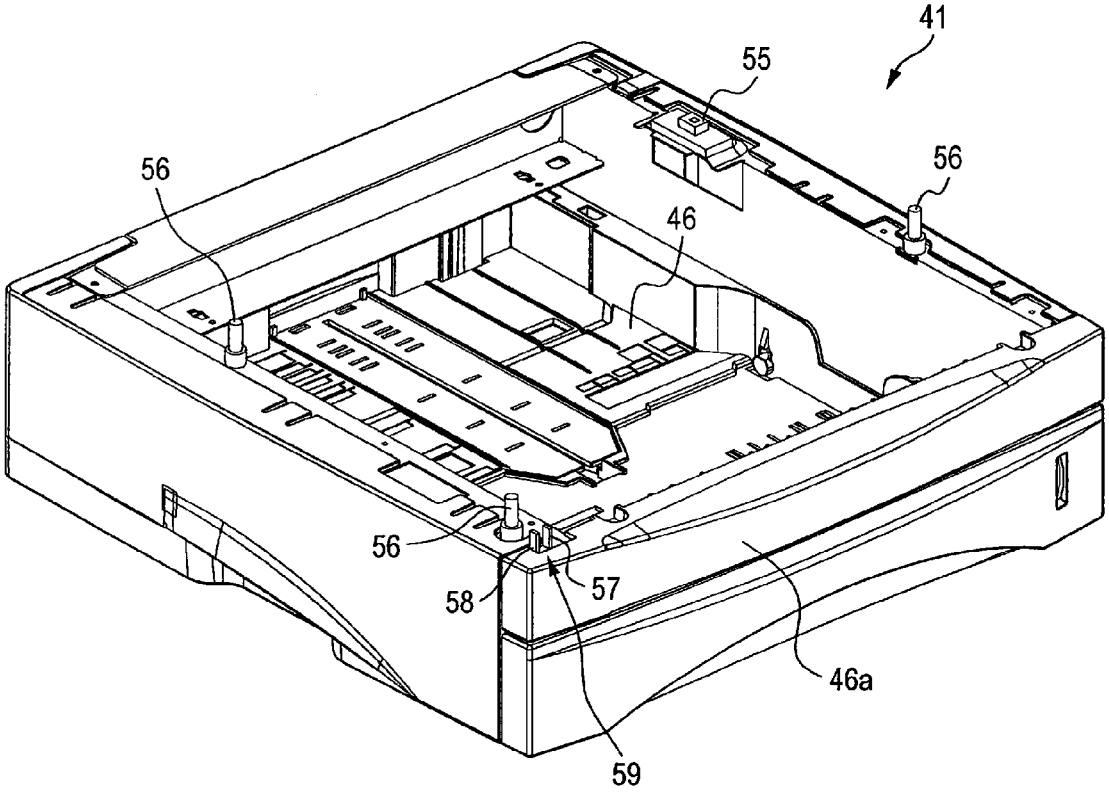
FIG. 3 is a perspective view showing a construction of an optional tray of the laser printer.

As shown in FIG. 3, a connector 55 and pins 56 are provided in an upper surface of the optional tray 41. When the optional tray 41 is mounted below the feeder 4, the connector 55 is electrically connected to a CPU 61 (FIG. 5) of the laser printer 1, which is provided in the main casing 2. The pins 56 are provided for positioning the optional tray 41 with respect to the main casing 2. Incidentally, FIG. 3 is a perspective view showing the construction of the optional tray 41, with the sheet urging plate 48, the sheet feed roller 52 and the separating pad 53 being removed.

Further, as shown in FIGS. 3 and 4, a light emitting element 57 and a light receiving element 58 are provided in the upper surface of the optional tray 41 provided above the handle 46*a* of the optional tray 46. That is, a shutter 6*c* for blocking an optical path from the light emitting element 57 to the light receiving element 58 when the sheet feed tray 6 is positioned in the normal position shown in FIG. 4 is provided in a rear surface (on the rear portion side) of the handle 6*a* of the sheet feed tray 6. Therefore, when the optional tray 41 is added, it is possible to know that the tray 6 is positioned in the normal position be determining whether light emitted by the light emitting element 57 is received by the light receiving element 58.

[Control System of Laser Printer 1]

Figure 5:
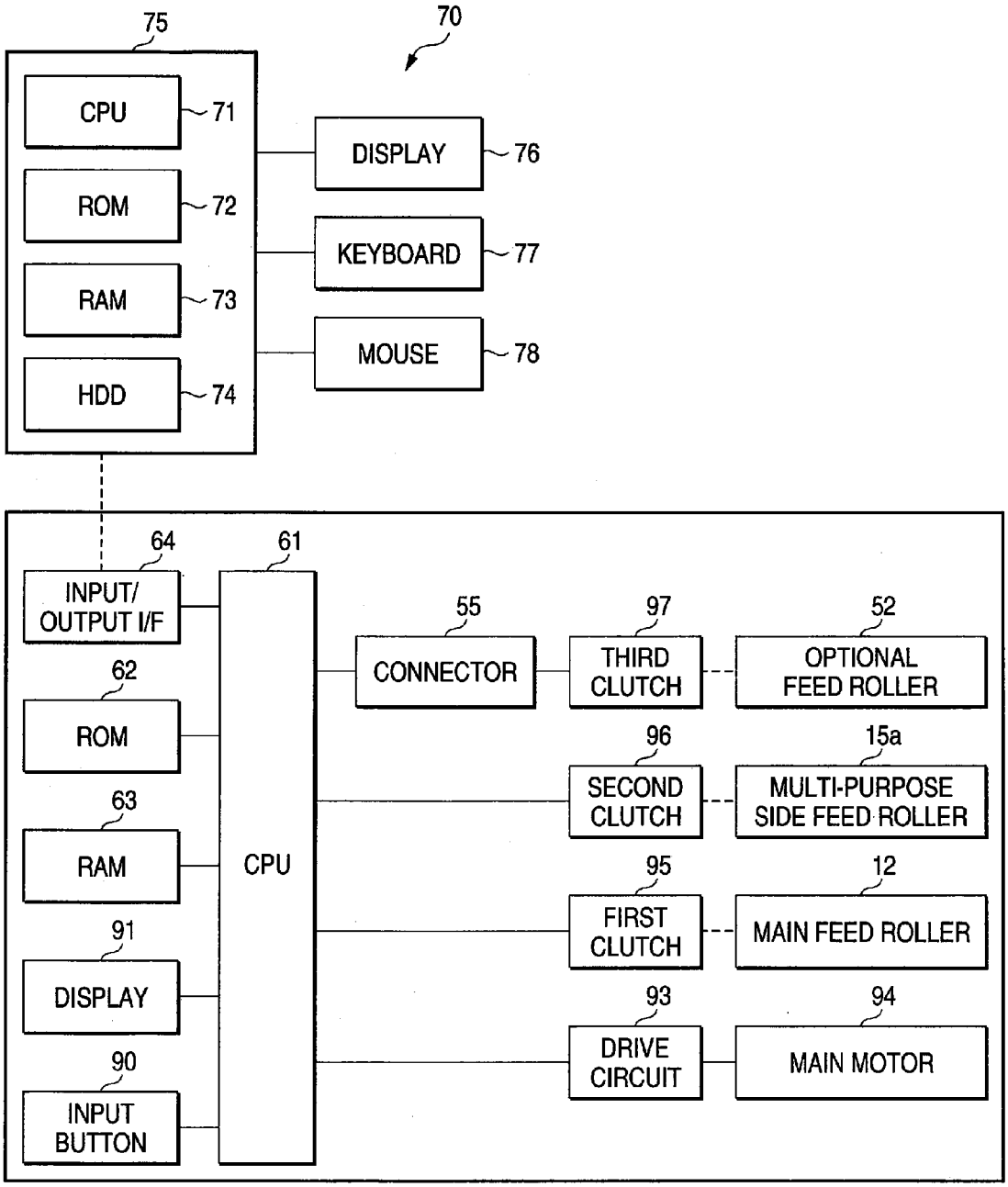
FIG. 5 is a block diagram showing a control system of the laser printer and a control system of a personal computer as an upper apparatus.

Now, a control system of the laser printer 1 will be described with reference to FIG. 5. As shown in FIG. 5, this control system includes a CPU (Central Processing Unit) 61 for executing various operations, a ROM (Read Only Memory) 62 for storing control programs and a RAM (Random Access memory) 63, which backs up in order to prevent content thereof from being erased when a power switch is OFF and stores various data temporarily. The CPU 61 can receive a printing job and an image forming instruction from a personal computer 70 as an upper apparatus through a communication circuit and an input/output interface (input output I/F) 64.

The personal computer 70 has a general construction including a main body 75, which includes a CPU 71, a ROM 72, a RAM 73 and a hard desk drive (HDD) 74, and a display 76, a keyboard 77 and a mouse 78, which are connected to the main body 75.

An input button 90 (FIG. 2) including a plurality of arrow keys, execution keys and canceling keys, etc., and a display 91, which are provided on a surface of the main casing 2, are further connected to the CPU 61 of the laser printer 1. Further, a main motor 94 for driving the photosensitive drum 23 and the various rollers is connected to the CPU 61 through a drive circuit 93 and a first clutch 95, a second clutch 96 and a third clutch 97 for transmitting driving force of the main motor 94 to the sheet feed roller 12, the multi-purpose side sheet feed roller 15*a* or the optional sheet feed roller 52 are also connected to the CPU 61. As previously mentioned, the third clutch 97 is connected to the CPU 61 when the connectors 55 are connected thereto.

[Printing Processing]

Now, the printing processing to be executed by the control system of the laser printer 1 will be described. In order to start the printing processing, a user displays a correspondence setting screen shown in FIG. 6 on the display 91 by operating the input button 90 and sets the kinds of sheets 3 held in the respective trays 6, 14 and 46 by operating the input button 90. It is possible to arbitrarily change the kind of sheet corresponding to one of the trays 6, 14 and 46 by operating such an arrow key after a cursor is pointed to one of the trays displayed on the display 91. Further, this correspondence displayed on the display 91 is stored in a predetermined memory area of the RAM 63 as needed.

Incidentally, though various kinds of sheets such as plain sheet, thin sheet, thick sheet, envelope and OHP sheet can be set to each of the trays 6, 14 and 46 in the correspondence setting screen, it is possible to set the thick sheet in only the multi-purpose tray 14.

Further, the user displays a priority order setting screen shown in FIG. 7 on the display 91 by operating the input button 90 and sets one of the trays or the kind of sheet to be printed (image-formed) first by operating the input button 90. In this priority order setting screen, one of three ways, that is, the printing in the sheet kind priority, in the tray priority and without priority setting, can be arbitrarily selected. The priority order displayed on the display 91 is stored in a predetermined memory area of the RAM 63 as needed.

Figure 8:
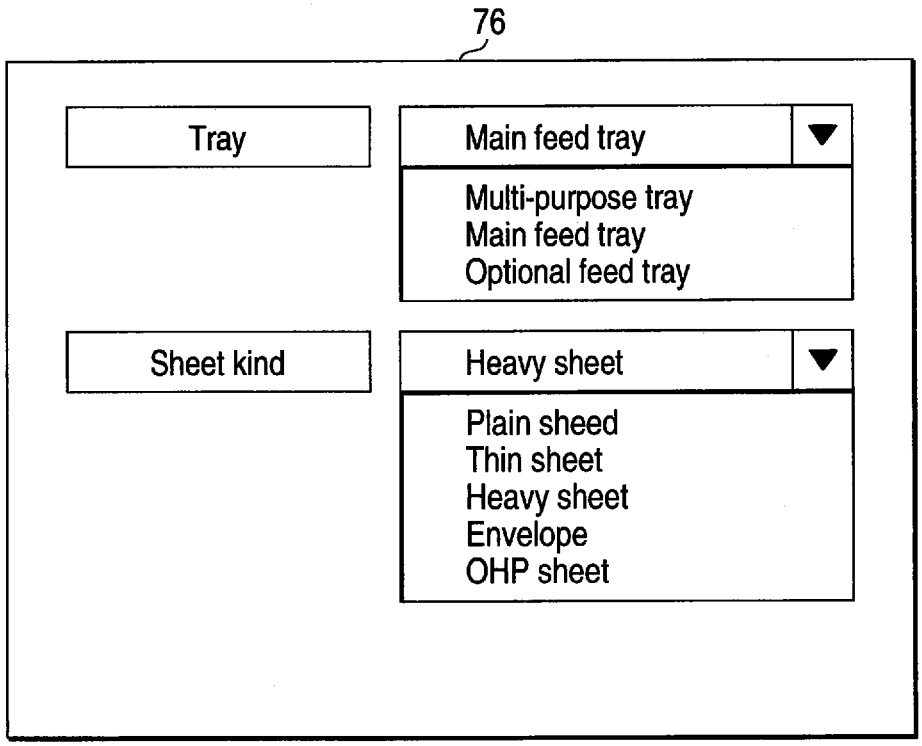
FIG. 8 shows a setting screen in the personal computer.

In transmitting printing data from the personal computer 70 by the user, the user displays a setting screen shown in FIG. 8 on the display 76 and sets the tray holding the sheets 3 on which the printing data is to be printed and the kind of sheet on which the printing data is to be printed. The tray and the sheet kind set in the screen are stored in a predetermined memory area of the RAM 73 by operating the keyboard 77 or the mouse 78. The setting of the tray and the sheet kind is transmitted to the laser printer 1 and stored in the predetermined memory area of the RAM 63.

Figure 9:
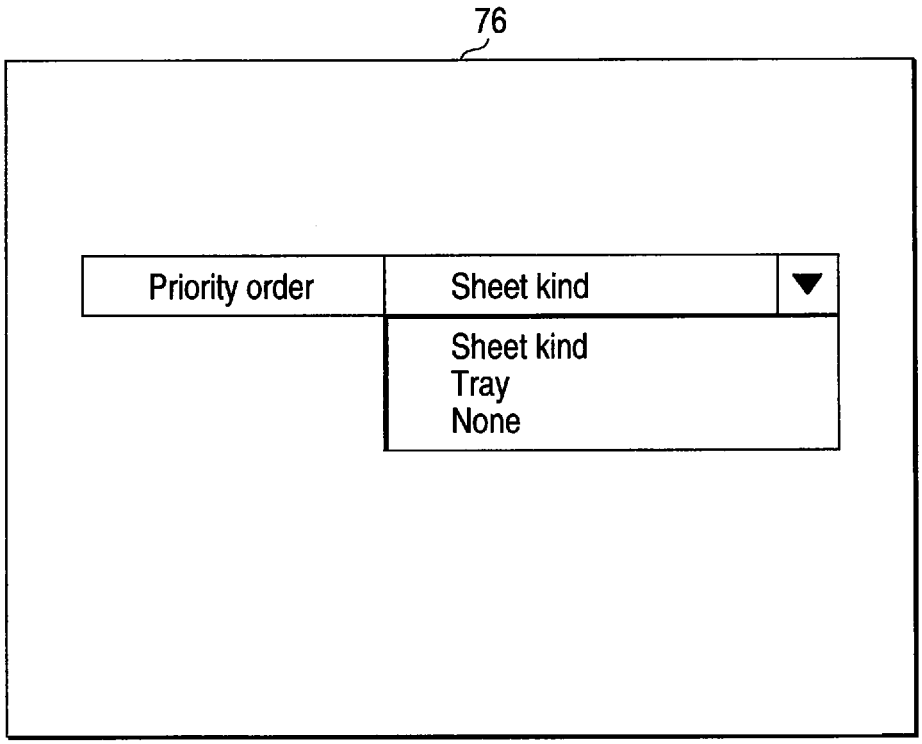
FIG. 9 shows a priority order setting screen in the personal computer.

Further, the user displays the priority order setting screen shown in FIG. 9 on the display 76 and sets one of the tray and the sheet kind as to be printed first. In this priority order setting screen, one of three ways, that is, the printing in the sheet kind priority, in the tray priority and without priority setting, can be arbitrarily selected. The priority order displayed on the screen is stored in a predetermined memory area of the RAM 73 by operating the keyboard 77 or the mouse 78. Incidentally, the priority order set on the personal computer 70 by the user may be transmitted to the laser printer 1 through an input/output I/F 64 and stored in a predetermined memory area of the RAM 63.

Figure 10:
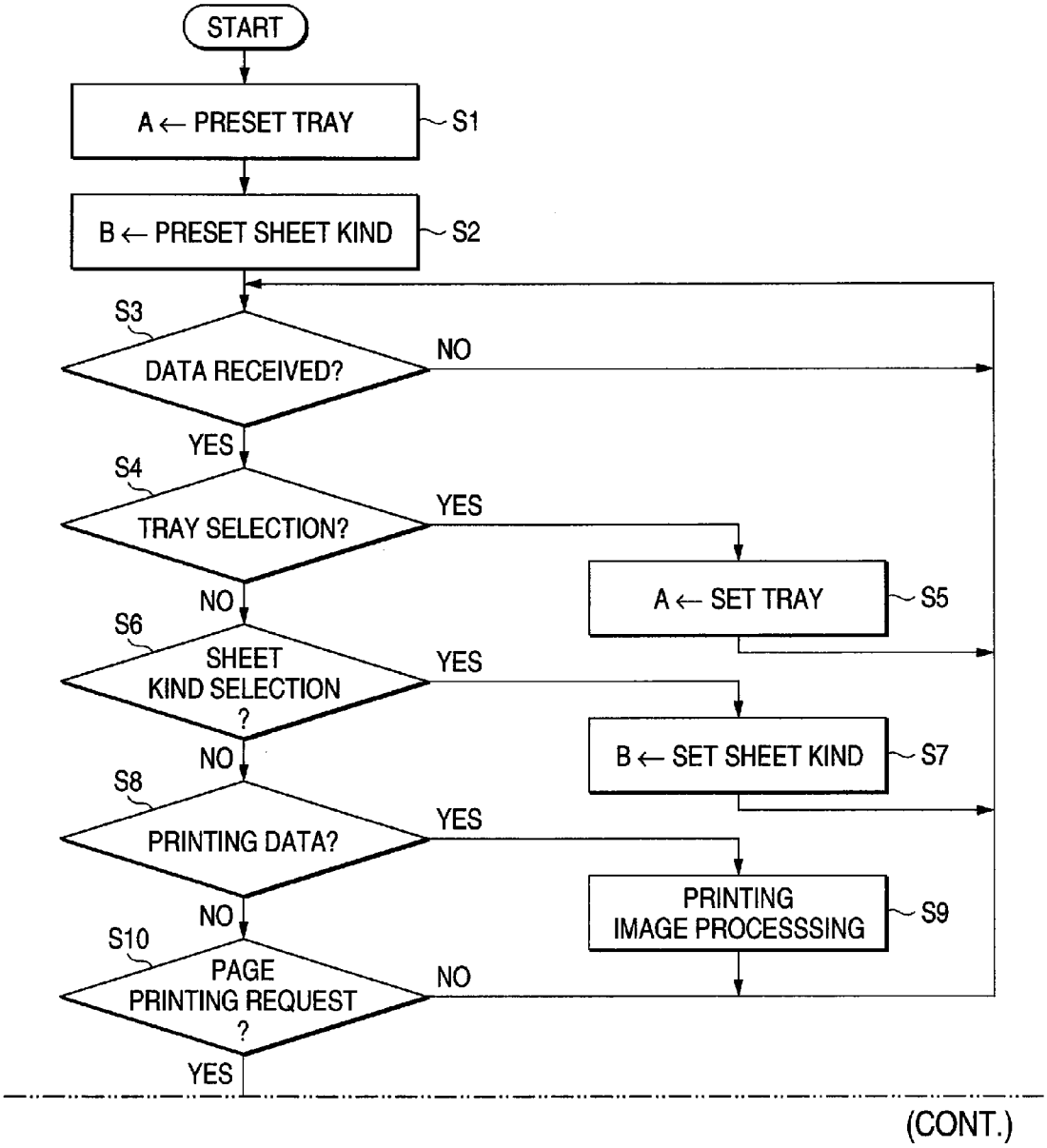
FIG. 10 is a flowchart showing a processing executed by the control system of the laser printer.

FIG. 10 is a flowchart showing a processing to be executed by the CPU 61 of the laser printer 1 on the basis of the program stored in the ROM 62. When the processing is started, a preset tray, for example, the main tray, is set in a predetermined memory area of the RAM 63 (S1) as a variable A and then a preset sheet kind, for example, the plain sheet, is set in a predetermined memory area of the RAM 63 as a variable B (S2). In the step S3, it is decided whether or not there is data received through the input/output I/F 64 and, when there is no data received (NO in S3), the processing becomes standby state in the step S3.

When there is the data received (YES in S3), the processing is shifted to the step S4 in which it is decided whether or not the data indicates a selection of the tray. When the received data indicates the tray selection (YES in S4), the processing is shifted to the step S5 in which the tray set by the data, that is, the content set in the setting screen shown in FIG. 8 in the personal computer 70 by the user, is set to the variable A and the processing is shifted to the step S3.

When the received data does not indicate the tray selection (NO in S4), the processing is shifted to the step S6 in which it is decided whether or not the received data indicates the sheet kind selection. When the received data indicates the sheet kind selection (YES in S6), the processing is shifted to the step S7 in which the sheet kind specified by the data, that is, the content set in the setting screen shown in FIG. 8 in the personal computer by the user, is set to the variant B and the processing is shifted to the step S3.

When the received data does not indicate the tray selection or the sheet kind (NO in S6), the processing shifts to S8 in which it is decided whether or not the received data is the main portion of the printing data indicating the printing content. When the received data is the main portion of the printing data (YES in S8), the processing is shifted to the step S9 in which the printing image processing such as expansion of the printing data into bit map data is executed and then the processing is shifted to the step S3.

When the received data does not belong to any of these data (NO in S8), it is decided in the step S10 whether or not the received data is a page printing request. When the received data is the page printing request (YES in S10), the printing is executed by the processing from the step S15 and, when the received data is not the page printing request (NO in S10), the processing is shifted to the step S3.

In the step S15, it is decided whether or not the priority order set in the screen shown in FIG. 7 and stored in the RAM 63 is the tray priority. Incidentally, when the priority order set on the side of the personal computer 70 is stored in the RAM 63, the decision may be made on the basis of the stored priority order. When it is tray priority (YES in S15), it is decided in the step S16 whether or not the sheet kind is designated in the screen shown in FIG. 6 to the tray set as the variable A. When the sheet kind is designated (YES in S16), the kind of sheet is set as the variable B in the step S17. When the kind is not designated (NO in S16), the processing is shifted to the step S18.

In the step S18, the first clutch 95, the second clutch 96 or the third clutch 97 is connected on the basis of the variable A and the sheet feeding processing is executed from the tray set as the variable A. Thereafter, in the step S19, the setting processing of the respective portions corresponding to the sheet kind of sheet set as the variable B is performed. For example, the fixing temperatures of the fixing unit 19 for OHP sheet, plain sheet and envelope are set higher in the order and an absolute value of transfer current to be supplied to the transfer roller 25 is larger for the envelope than that for the OHP sheet or the plain sheet. Incidentally, when the kind of sheet is not defined as in the case of the optional tray 46 shown in FIG. 6, the setting is performed according to a command indicated by the transmitted data or according to a preset value. In the step S20, the printing processing is executed according to the printing data and the processing is ended.

On the other hand, when the priority order set in the screen shown in FIG. 7 is not the tray priority (NO in S15), it is decided in the step S21 whether or not the priority order stored in the RAM 63 is the sheet kind priority. Incidentally, when the priority order set on the side of the personal computer 70 is stored in the RAM 63, the decision may be made on the basis of the priority order in the RAM 63. When it is not the sheet kind priority (NO in S21), the processing is shifted to the step S18 and, when it is the sheet king priority (YES in S21), the processing is shifted to the step S22.

In the step S22, it is decided on the basis of the correspondence set in the screen shown in FIG. 6 whether or not there is a tray corresponding to the sheet kind set as the variable B at that time. When there is such sheet feed tray (YES in S22), the processing is shifted to the step S18 after the tray is set as the variable A in the step S23. When there is no such tray (NO in S22), the processing is shifted to the step S18. Incidentally, there may be a case where a plurality of trays for one and the same sheets. In such case, one of these trays is selected according to the priority order of tray in the step S23.

In this aspect, when both the tray priority and the sheet kind priority are designated (S5, S7), it is possible to feed sheets as follow. When the tray priority is set (YES in S15), it is possible to feed sheets from the set tray and, when the sheet kind priority is set (YES in S21), a tray holding the sheets 3 is searched and, when there is the tray holding the sheets 3 (YES in S22), the sheets 3 are fed from the tray (S18). The setting of the fixing temperature and the transfer current, etc., is changed correspondingly to the kind of sheets fed (S19). According to this aspect, it is possible to properly select the sheets 3 on the basis of the priority order even when there is no designated tray and there is no designated kind of sheet. Therefore, it is possible to prevent the laser printer 1 from becoming the sleep state and to thereby improve the operability. In addition, since the image forming condition corresponding to the kind of selected sheet 3 is set, it is possible to obtain a high printing performance without errors such as fixing error.

Further, in this aspect, when only one of the tray and the sheet kind can be designated on the personal computer 70, that is, for example, when an application software run on the personal computer 70 can designate only one of the tray and the sheet kind or when only one of the tray and the kind of sheet is designated, it is always possible to form the image on the basis of the tray or the sheet kind, which can be designated by the user, by setting the priority order on the side, in which the designation is possible or the designation is set, and to thereby improve the operability.

Incidentally, the main sheet feed tray 6, the multi-purpose tray 14 and the optional sheet feed tray 46 function as the tray. The main feed roller 12, the multi-purpose side feed roller 15*a* and the optional feed roller 52 function as the sheet feed unit. The processing related to the display on the screen shown in FIG. 6 and the memory area of the ROM 62 storing the program for executing the processing function as the correspondence storing processing and the correspondence storing unit, respectively. The processing related to the display on the screen shown in FIG. 7 and the memory area of the ROM 62 storing the program for executing the processing function as the priority setting processing and the priority setting unit, respectively. The processing in the steps S15 to S23 shown in FIG. 10 and the memory area of the ROM 62 storing the program for executing the processing function as the sheet feed control processing and the sheet feed control unit, respectively. The processing in the step S19 shown in FIG. 10 and the memory area of the ROM 62 storing the program for executing the processing function as the setting change processing and the setting change unit, respectively.

The present invention is not limited to the above described aspect and can be modified in various manners within the scope of the present invention. For example, though the designation of the tray and the sheet kind is performed from the personal computer 70 in the described aspect, it can be made on the display 91 of the laser printer 1. In such case, the input button 90 and the display 91 function as the tray designating unit and the sheet kind designating unit, respectively. Further, the table storing the correspondence shown in FIG. 6 may be provided on the side of the personal computer 70. In the step S15, the decision may be made on the basis of the priority order set in the screen on the personal computer 70 side shown in FIG. 9. Further, when the tray and the sheet kind are designated by the personal computer 70, the processing for selecting the tray according to the designation may be executed on the side of the personal computer 70.

[Other Embodiments of Printing Processing]

Figure 11:
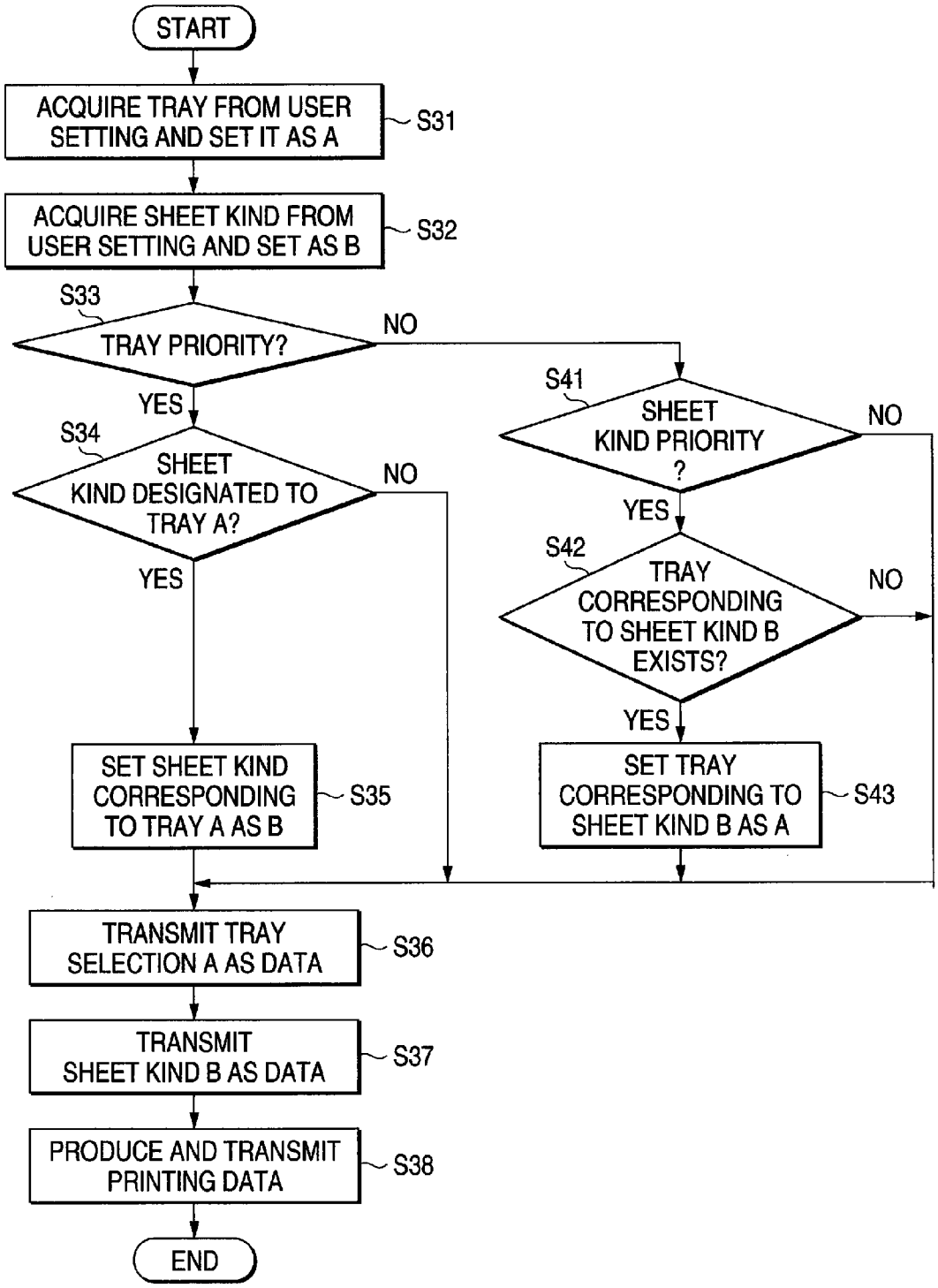
FIG. 11 is a flowchart showing a processing executed by the personal computer in another aspect.

FIG. 11 shows a flowchart showing a processing of the personal computer 70 in another aspect of the present invention. When the execution of printing is instructed by the keyboard 77 or the mouse 78, the CPU 71 executes this processing on the basis of the program stored in the ROM 72. In this processing, the tray selected by the user in the screen shown in FIG. 8 is acquired from the user setting and is set as the variable A (S31) In the next step S32, the sheet kind selected by the user in the screen shown in FIG. 8 is acquired from the user setting and is set as the variable B.

In the step S33, it is decided whether or not the priority order set in the screen shown in FIG. 9 is the tray priority. When it is the tray priority (YES in S33), it is decided in the step S34 whether or not the sheet kind is designated from the screen similar to that shown in FIG. 6 on the side of the personal computer 70 to the tray set as the variable A at that time. When the kind of sheet is designated (YES in S34), the processing is shifted to the step S36 after the sheet kind is set as the variable B in the step S35. When the sheet kind is not designated (NO in S34), the processing is shifted to the step S36 as it is.

In the step S36, the tray set as the variable A is transmitted as data to the laser printer 1 and, in the step S37, the sheet kind set as the variable B at that time is transmitted to the laser printer 1 as data. Further, in the step S38, the printing data is produced and transmitted to the laser printer 1 and the processing is ended.

On the other hand, when the priority order set in the screen shown in FIG. 9 is not the tray priority (NO in S33), it is decided in the step S41 whether or not the priority order is the sheet kind. When it is not the sheet kind priority (NO in S41), the processing is shifted to the step S36. In the case of the sheet kind priority (YES in S41), the processing is shifted to the step S42.

In the step S42, it is decided whether or not there is a tray corresponding to the sheet kind set as the variable B at that time on the basis of the correspondence set in the screen similar to that shown in FIG. 6 on the side of the personal computer 70. When there is the tray (YES in S42), the processing is shifted to the step S36 after the tray is set as the variable A in the step S43. When there is no such tray (NO in S42), the processing is shifted to the step S36.

In this aspect, the tray is selected on the side of the personal computer 70 on the basis of the priority order, etc. Therefore, the effect similar to that obtained by the above described aspect is obtained even when the laser printer 1 does not have the data table shown in FIG. 6.

Incidentally, in the described aspect, the processing related to the screen display similar to that shown in FIG. 6 on the side of the personal computer 70 and the memory area of the ROM 72 storing the program for executing the processing function as the correspondence storing processing and the correspondence storing unit, respectively. The processing related to the screen shown in FIG. 9 and the memory area of the ROM 72 storing the program for executing the processing function as the priority setting processing and the priority setting unit, respectively. The processing in the steps S33 to S43 shown in FIG. 11 and the memory area of the ROM 72 storing the program for executing the processing function as the data transmission processing and the data transmission unit, respectively. Further, the present invention is not limited to the described image forming apparatus of the electronic photography system and the present invention can be applied to various image forming apparatus such as ink jet printer, etc.

What is claimed is:

1. An image forming apparatus comprising:

an image forming device configured to form an image on a sheet;

a plurality of trays each configured to hold the sheet on which the image is formed by the image forming device;

a sheet feed device configured to feed the sheet held in one of the plurality of the trays;

a user interface configured to receive an input;

a processor; and memory storing instructions, when executed by the processor, causing the image forming apparatus to:

store correspondence between trays and kinds of sheets held in the trays in a storage device;

set priority to a designation of the tray or to a designation of the kind in the storage device based on the input received by the user interface;

set one of the trays in the storage device based on the input received by the user interface;

set one of the kinds in the storage device based on the input received by the user interface;

receive image data and a printing request which designates the tray and the kind of sheets;

determine whether the priority set in the storage device is given to the designation of the tray or to the designation of the kind after receiving the image data and the printing request;

cause the sheet feed device to feed the sheet from the one of the trays set in the storage device when the priority is given to the designation of the tray;

search one of the trays that holds the sheet of the one of the kinds set in the storage device on the basis of the stored correspondence between trays and kinds of sheets to cause the sheet feed device to feed the sheet from the searched tray when the priority is given to the designation of the kind;

when the tray which holds the kind of sheets designated by the printing request does not exist in the case that the priority set in the storage device is given to the designation of the kind of sheets, cause the sheet feed device to feed the sheet from the tray designated by the printing request;

when a plurality of the trays which hold the same kind of sheets designated by the printing request exist in the case that the priority set in the storage device is given to the designation of the kind of sheets, select one of the plurality of the trays which hold the same kind of sheets according to a priority order of trays and cause the sheet feed device to feed the sheet from the one of the plurality of the trays; and change a setting of the image forming device correspondingly to the kind of sheet actually fed by the sheet feed device, wherein the change of the setting of the image forming device comprises changing a printing property of the image forming device based on a physical characteristic of the kind of sheet actually fed by the sheet feed device.

2. The image forming apparatus as claimed in claim 1, wherein the instructions further comprise at least one of designating one of the plurality of the trays and designating one of the kinds of sheets.

3. The image forming apparatus as claimed in claim 1, wherein the sheets includes at least plain sheets and thick sheets.

4. The image forming apparatus as claimed in claim 1, wherein the image forming device comprises:

an electrostatic latent image carrier having a surface on which an electrostatic latent image is formed;

a developing device that develops the electrostatic latent image by attaching developer on the surface of the electrostatic latent image carrier;

a transfer device that transfers the developer attached to the surface of the electrostatic latent image carrier by the developing device to the sheet; and a fixing device that fixes the developer transferred to the sheet by the transfer device by heating, and wherein the change of the setting changes at least one of current supply to the transfer unit and fixing temperature of the fixing unit as the setting of the image forming unit.

5. The image forming apparatus according to claim 1, wherein the printing property of the image forming device include at least one of temperature of a fixing unit configured to fix a developer on the sheet, and speed at which the sheet is fed.

6. The image forming apparatus according to claim 1, wherein:

the memory stores a first variable representing the designation of tray and a second variable representing the designation of the kind, when the priority set in the storage device is given to the designation of the tray, the first variable does not change and the second variable is set to a value corresponding to the kind of the sheet stored in the tray represented by the first variable, the property of the time forming device is changed based on the second variable.

7. The image forming apparatus according to claim 1, wherein in a case that both the tray and the kind are set based on the input received by the user interface, it is determined whether the priority set in the storage is given to the designation of the tray or to the designation of the kind after receiving the image data and the printing request.

8. The image forming apparatus according to claim 1, wherein the instructions, when executed by the processor, causes the image forming apparatus to, when the storage device stores the correspondence between the tray designated by the printing request and the type of the sheet in the case that the priority set in the storage device is given to the designation of the tray, change the type of the sheet designated by the printing request to the type of the sheet in the correspondence stored in the storage device.

9. A non-transitory computer-readable medium having a computer program stored thereon for execution by an image forming apparatus, which includes an image forming device configured to form an image on a sheet, a plurality of trays each configured to hold the sheet on which the image is formed by the image forming device, a sheet feed device configured to feed the sheet held in one of the plurality of the trays, a user interface configured to receive an input, a processor, and memory storing instructions, the computer program comprising the steps of:

correspondence storing processing for storing correspondence between trays and kinds of sheets held in the trays in a storage device;

priority setting processing for setting priority to a designation of the tray or to a designation of the kind in the storage device based on the input received by the user interface, the priority setting processing comprising:

setting one of the trays in the storage device based on the input received from the user interface;

setting one of the kinds in the storage device based on the input received from the user interface;

receiving image data and a printing request which designates the tray and the kind of sheets; and determining whether the priority set in the storage device is given to the designation of the tray or to the designation of the kind after receiving the image data and the printing request;

sheet feed control processing for feeding the sheet from the one of the trays set in the storage device when the priority is given to the designation of the tray, for searching one of the trays that holds the sheet of the one of the kinds set in the storage device on the basis of the stored correspondence between trays and kinds of sheets to feed the sheet from the searched tray when the priority is given to the designation of the kind;

when the tray which holds the kind of sheets designated by the printing request does not exist in the case that the priority set in the storage device is given to the designation of the kind of sheets, feeding the sheet from the tray designated by the printing request; and when a plurality of the trays which hold the same kind of sheets designated by the printing request exist in the case that the priority set in the storage device is given to the designation of the kind of sheets, selecting one of the plurality of the trays which hold the same kind of sheets according to a priority order of trays and feeding the sheet from the one of the plurality of the trays; and setting change processing for changing a setting of the image forming device correspondingly to the kind of sheet actually fed by the sheet feed control processing, wherein the setting change processing comprises changing a printing property of the image forming device based on a physical characteristic of the kind of sheet actually fed by the sheet feed device.

10. The non-transitory computer-readable medium according to claim 9, wherein the print property of the image forming device include at least one of temperature of a fixing unit configured to fix a developer on the sheet, and speed at which the sheet is fed.

11. The non-transitory computer-readable medium according to claim 9, wherein:

the memory stores a first variable representing the designation of tray and a second variable representing the designation of the kind, when the priority set in the storage device is given to the designation of the tray, the first variable does not change and the second variable is set to a value corresponding to the kind of the sheet stored in the tray represented by the first variable, the property of the time forming device is changed based on the second variable.

12. The non-transitory computer-readable medium according to claim 9, wherein in a case that both the tray and the kind are set based on the input received by the user interface, it is determined whether the priority set in the storage is given to the designation of the tray or to the designation of the kind after receiving the image data and the printing request.

13. The non-transitory computer-readable medium according to claim 9, wherein the priority setting processing further comprises, when the storage device stores the correspondence between the tray designated by the printing request and the type of the sheet in the case that the priority set in the storage device is given to the designation of the tray, changing the type of the sheet designated by the printing request to the type of the sheet in the correspondence stored in the storage device.

14. An image forming system comprising:

an image forming apparatus including an image forming device configured to form an image on a sheet, a plurality of trays each configured to hold the sheet on which the image is formed by the image forming device, a sheet feed device configured to feed the sheet held in one of the plurality of the trays, a user interface configured to receive an input, a processor, and memory storing instructions;

an upper apparatus configured to transmit data to the image forming apparatus;

a correspondence storing device configured to store correspondence between trays and kinds of sheets held in the trays in a storage device;

a priority setting device configured to set priority to a designation of the tray or to a designation of the kind in the storage device based on the input received by the user interface, the priority setting device further configured to:

set one of the trays in the storage device based on the input received from the user interface;

set one of the kinds in the storage device based on the input received from the user interface;

receive image data and a printing request which designates the tray and the kind of sheets; and determine whether the priority set in the storage device is given to the designation of the tray or to the designation of the kind after receiving the image data and the printing request;

a sheet feed control device provided in the image forming apparatus which is configured to:

cause the sheet feed device to feed the sheet from the one of the trays set in the storage device when the priority is given to the designation of the tray;

search one of the trays that holds the sheet of the one of the kinds set in the storage device on the basis of the stored correspondence between trays and kinds of sheets to cause the sheet feed device to feed the sheet from the searched tray when the priority is given to the designation of the kind and data designating the kind of the sheet is transmitted from the upper apparatus;

when the tray which holds the kind of sheets designated by the printing request does not exist in the case that the priority set in the storage device is given to the designation of the kind of sheets, and cause the sheet feed device to feed the sheet from the tray designated by the printing request; and when a plurality of the trays which hold the same kind of sheets designated by the printing request exist in the case that the priority set in the storage device is given to the designation of the kind of sheets, select one of the plurality of the trays which hold the same kind of sheets according to a priority order of trays and cause the sheet feed device to feed the sheet from the one of the plurality of the trays; and a setting change device provided in the image forming apparatus which changes a setting of the image forming device correspondingly to the kind of sheet actually fed by the sheet feed device, wherein the setting change device is configured to change a printing property of the image forming device based on a physical characteristic of the kind of sheet actually fed by the sheet feed device.

15. The image forming system as claimed in claim 14, wherein the correspondence storing device and the priority setting device are provided in the upper apparatus.

16. The image forming system according to claim 14, wherein the priority setting device is further configured to, when the storage device stores the correspondence between the tray designated by the printing request and the type of the sheet in the case that the priority set in the storage device is given to the designation of the tray, change the type of the sheet designated by the printing request to the type of the sheet in the correspondence stored in the storage device.

17. An image forming system comprising:

an image forming apparatus including an image forming device configured to form an image on a sheet, a plurality of trays each configured to hold the sheet on which the image is formed by the image forming device, a sheet feed device configured to feed the sheet held in one of the plurality of the trays, a user interface, a processor, and memory storing instructions; and an upper apparatus configured to transmit data to the image forming apparatus, wherein the upper apparatus comprises:

a correspondence storing device configured to store correspondence between trays and kinds of sheets held in the trays in a storage device of the image forming apparatus;

a priority setting device configured to set priority to a designation of the tray or to a designation of the kind in the storage device based on the input received by the user interface, the priority device further configured to:

set one of the trays in the storage device based on the input received from the user interface;

set one of the kinds in the storage device based on the input received from the user interface;

receive image data and a printing request which designates the tray and the kind of sheets; and determine whether the priority set in the storage device is given to the designation of the tray or to the designation of the kind after receiving the image data and the printing request;

a data transmission device configured to:

transmit data designating the one tray set in the storage device to the image forming apparatus when the priority is given to the designation of the tray;

search one of the trays that holds the sheet of the one of the kinds set in the storage device on the basis of the stored correspondence between trays and kinds of sheets when the priority is given to the designation of the kind to transmit data designating the tray searched and data designating the kind of sheet to the image forming apparatus;

when the tray which holds the kind of sheets designated by the printing request does not exist in the case that the priority set in the storage device is given to the designation of the kind of sheets, cause the sheet feed device to feed the sheet from the tray designated by the printing request; and when a plurality of the trays which hold the same kind of sheets designated by the printing request exist in the case that the priority set in the storage device is given to the designation of the kind of sheets, select one of the plurality of the trays which hold the same kind of sheets according to a priority order of trays and cause the sheet feed device to feed the sheet from the one of the plurality of the trays; and a setting change device which changes a setting of the image forming device correspondingly to the kind of sheet actually fed by the sheet feed device, wherein the setting change device is configured to change a printing property of the image forming device based on a physical characteristic of the kind of sheet actually fed by the sheet feed device.

18. The image forming system according to claim 17, wherein the priority setting device is further configured to, when the storage device stores the correspondence between the tray designated by the printing request and the type of the sheet in the case that the priority set in the storage device is given to the designation of the tray, change the type of the sheet designated by the printing request to the type of the sheet in the correspondence stored in the storage device.

19. A non-transitory computer-readable medium having a computer program stored thereon for execution by a computer, the computer program comprising the steps of:

correspondence storing processing for storing correspondence between trays and kinds of sheets held in the trays in a storage device of an image forming apparatus including an image forming device configured to form an image on a sheet;

priority setting processing for setting priority to a designation of the tray or to a designation of the kind in the storage device based on an input received by a user interface, the priority setting processing comprising:

setting one of the trays in the storage device based on the input received from the user interface;

setting one of the kinds in the storage device based on the input received from the user interface;

receiving image data and a printing request which designates the tray and the kind of sheets; and determining whether the priority set in the storage device is given to the designation of the tray or to the designation of the kind after receiving the image data and the printing request;

data transmission processing for transmitting data designating the one of the trays set in the storage device to the image forming apparatus when the priority is given to the designation of the tray, and for transmitting data designating the tray and data designating the kind of sheet to the image forming apparatus by searching one of the trays that holds the sheet of the one of the kinds set in the storage device on the basis of the stored correspondence between trays and kinds of sheets to feed the sheet to the image forming device from the tray searched when the priority is given to the kind and the kind of the sheet is assigned;

when the tray which holds the kind of sheets designated by the printing request does not exist in the case that the priority set in the storage device is given to the designation of the kind of sheets, feeding the sheet from the tray designated by the printing request; and when a plurality of the trays which hold the same kind of sheets designated by the printing request exist in the case that the priority set in the storage device is given to the designation of the kind of sheets, selecting one of the plurality of the trays which hold the same kind of sheets according to a priority order of trays and feeding the sheet from the one of the plurality of the trays; and setting change processing for changing a setting of the image forming device correspondingly to the kind of sheet actually fed from the tray, wherein the setting change processing comprises changing a printing property of the image forming device based on a physical characteristic of the kind of sheet actually fed from the tray.

20. The non-transitory computer-readable medium according to claim 19, wherein the priority setting processing further comprises, when the storage device stores the correspondence between the tray designated by the printing request and the type of the sheet in the case that the priority set in the storage device is given to the designation of the tray, changing the type of the sheet designated by the printing request to the type of the sheet in the correspondence stored in the storage device.

* * * * *